US007419161B2

(12) United States Patent
Tsung

(10) Patent No.: US 7,419,161 B2
(45) Date of Patent: Sep. 2, 2008

(54) NO PUSH CARD GAME

(76) Inventor: Andy Tsung, 3903 Velma Ave., El Monte, CA (US) 91731

( * ) Notice: Subject to any disclaimer, the term of this patent is extended or adjusted under 35 U.S.C. 154(b) by 256 days.

(21) Appl. No.: 11/273,898

(22) Filed: Nov. 15, 2005

(65) Prior Publication Data

US 2007/0108702 A1 May 17, 2007

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,275,415 A * 1/1994 Wisted ..... 273/274
5,314,193 A * 5/1994 Ferrer ..... 273/292
5,397,128 A * 3/1995 Hesse et al. ..... 273/292
5,613,682 A * 3/1997 Otuzbiryan ..... 273/292
5,863,042 A * 1/1999 Lo ..... 273/292
5,897,436 A * 4/1999 Singer et al. ..... 273/293
6,098,984 A * 8/2000 Moore, Jr. ..... 273/292
6,237,916 B1 * 5/2001 Webb ..... 273/292
6,247,697 B1 * 6/2001 Jewett ..... 273/292
6,345,823 B1 * 2/2002 Webb ..... 273/292
6,386,973 B1 * 5/2002 Yoseloff ..... 463/13
6,543,773 B2 * 4/2003 Mims ..... 273/292
6,575,466 B1 * 6/2003 Lizak ..... 273/292
6,575,467 B1 * 6/2003 Kal ..... 273/292
6,592,125 B1 * 7/2003 Lizak ..... 273/292
6,609,711 B1 * 8/2003 Campbell ..... 273/274
6,805,353 B2 * 10/2004 Williams ..... 273/292
6,884,168 B2 * 4/2005 Wood et al. ..... 463/23
7,168,705 B2 * 1/2007 Schibetta ..... 273/292
2002/0036381 A1 * 3/2002 Scibetta ..... 273/292
2003/0162424 A1 * 8/2003 Berman ..... 439/131
2004/0127274 A1 * 7/2004 Franklin ..... 463/11
2005/0104292 A1 * 5/2005 Schultz ..... 273/292
2006/0027968 A1 * 2/2006 Snow ..... 273/292
2006/0091607 A1 * 5/2006 Javier ..... 273/292

(Continued)

*Primary Examiner*—Gene Kim
(74) *Attorney, Agent, or Firm*—Raymond Y. Chan; David and Raymond Patent Firm

(57) ABSTRACT

A card game has three card hands in a round. A player may change a single card in the three-card hand. A player compares three card hands for hand strength first categorizing hands into classes; wherein the highest special hand is the three of a kind. The second highest special class is the three face card hand. A standard hand class is below two special hand classes. Players tie break any three of a kind special class hands by rank by the individual hierarchical value of the highest card in the three of a kind special class hand. Players tie break any three face card special class hands by rank by the individual hierarchical value of the highest card in the three face card special class hand. Players tie break any standard hand by point total criteria. The point total equals the units digit of the sum numerical value of the three card hand. Players tie break any similar point total standard hands by rank by assigning a special two face card rank higher than a standard rank. Players tie break any standard class special two face card rank by the individual hierarchical value of the highest face card. Players tie break any standard class standard rank by the individual hierarchical value of the highest card. All cards are categorized into four suits when determining the individual hierarchical value of a card.

14 Claims, 2 Drawing Sheets

| Numerical Value | Card |
|---|---|
| 1 | A |
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| 10 | J |
| 10 | Q |
| 10 | K |

U.S. PATENT DOCUMENTS

2007/0035090 A1* 2/2007 Cheng ..... 273/292
2007/0035091 A1* 2/2007 Tang ..... 273/292
2007/0132182 A1* 6/2007 Chen ..... 273/292
2007/0135195 A1* 6/2007 Albino ..... 463/13

* cited by examiner

| Numerical Value | Card |
|---|---|
| 1 | A |
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| 10 | J |
| 10 | Q |
| 10 | K |

Fig. 1

| Rank | Card |
|---|---|
| Highest | Two face cards in a standard hand. |
| 1 | As, Ah, Ad, Ac |
| 2 | Ks, Kh, Kd, Kc |
| 3 | Q… |
| 4 | J… |
| 5 | 10… |
| 6 | 9… |
| 7 | 8… |
| 8 | 7… |
| 9 | 6… |
| 10 | 5… |
| 11 | 4… |
| 12 | 3… |
| 13, Lowest | 2s, 2h, 2d, 2c |

Fig. 2

| Hand # | Example Hand |
|---|---|
| 1 | A, A, A |
| 2 | K, Q, J |
| 3 | K, Q, 9 |
| 4 | A, 8, 10 |
| 5 | K, 10, 9 |
| 6 | 10, 10, 9 |
| 7 | 9, 5, 5 |
| 8 | 8, 7, 4 |
| 9 | 7, 6, 6 |
| 10 | 5, 2, 2 |
| 11 | 4, 3, 2 |
| 12 | 4, 4, 2 |

Fig. 3

NO PUSH CARD GAME

DISCUSSION OF RELATED ART

A variety of card games have been used in Game Systems that include poker and a variation on poker. The game of poker is fun but often produces a draw or push. To understand the typical card game system one may categorize the various games systems into three kinds. The first kind is a card game system typical in Las Vegas where the House places a bet and participates in the game by wagering money. The second kind of system is where the House operates by charging a service charge. The third type of system is where the players are casual and players rotate as House, and the House does not require a service charge or place a bet. There are typical House rules that apply in a service charge arrangement. These games are well suited for tournament play.

Typical house rules for a service charge arrangement are as follows. No wager can be removed until all hands are opened. No players play against or make a wager against the House. The House does not place a bet, collect winnings or pay losses. The house dealer acts as a referee and game administrator. All cash will be changed to chips and all bets will be paid off in chips. No other side bets or proposition bets are allowed.

The house dealer will collect a service fee from each player based upon the amount of the player wager up to a maximum service fee amount. For example, the service fee can be $1 for each bet placed. The service fee is collected in advance for each bet before the cards are distributed to each player. Each player must have the full minimum bet after paying the service fee.

Each table has a spread limit defining the minimum and maximum amounts that may be wagered in each spot. This spread limits shall be displayed at each table. Each player must bet at least the table minimum. Bets less than the table minimum posted will be ignored and receive no action. Likewise, bets that are over the maximum table limit will also be ignored and receive no action. Only the amount over the table maximum will be ignored.

The house can establish typical card game rules such as the following. Any attempts to switch, pass and/or holdout cards will cause a hand to be fowled and the forfeiture of that wager to the extent that money covers. Any player removing a losing bet may be barred. Any player replacing House cards with their own cards may also be barred. A player who removes the winnings wager from the betting circle may be paid the minimum bet if the correct amount of the wager cannot be determined. All players are forbidden to show or discuss with their hands with any other player. In the event that's players have discussed their hands, the hand will be played according to a predetermined 'House Way'. A round of play terminates either when all players' hands are played or wagers are settled. Management may generally reserve the right to make the judgments that are in the best interests of the game.

BRIEF DESCRIPTION OF THE DRAWINGS

FIG. 1 is a numerical value chart.

FIG. 2 is a rank chart.

FIG. 3 is a table of example hands.

DETAILED DESCRIPTION OF THE PREFERRED EMBODIMENT

The game begins with a game set up. The game is played at a table with a standard deck of 52 cards having four suits of each of an ace, 2-10 cards, a Jack, a queen and a King. The dealer shuffles the cards at the start of the game. The game proceeds in a clockwise direction. The house dealer does not participate in the actual play of the game and has no interest in the outcome of any round.

In each round of play, there is preferably a maximum of 10 hands dealt. The dealer deals cards to a predetermined number of spots, preferably 10. All actions go clockwise starting with the player designated by the action button. The player who has the button is the first player. Typically, the button begins at the first spot. The first player has the option to cut the cards after the dealer has dealt the cards. The button advances a single spot each round allowing players a more equal opportunity to be the first player. A player may pass the button to the next player if not player does not wish to receive the button and be the first player.

A minimum wager may be set, preferably at $10 for a given round of play.

Each participant is required to place a fixed wager. Anywhere from two to ten players can participate at any of the 10 spots.

The first player has the first right of refusal to purchase any empty spots not occupied by other players. The second player has the second right of refusal. The subsequent players are similarly ranked and may exercise their respective rights of refusal until all empty spots have been purchased, or until the latest ranked player refuses purchase.

The players may make a first bet and a second bet. The first bet is placed in the first bet position and the second bet is placed in the second bet position. The first bet has a first bet service charge, and the second bet has a second bet service charge, preferably half of the first bet service charge.

The dealer takes the service charge chips, then deals a single hand to each spot. Each spot has a first bet and second bet allowing a player to place two bets in each spot purchased. The dealer deals a hand of three cards face down to each player.

In any given round of play, anywhere from two hands to ten hands dealt will actually be played. Each player has a one time option to change a single replacement card in each hand dealt.

Hand Hierarchy

More specifically, to determine the strength of the hand, the hands are categorized into a hierarchy with three criteria considering: first the hand class, then if necessary the point total, and finally if necessary the rank of the hand.

Each card has an individual hierarchical value. The highest cards in the deck are the aces, followed by the kings, followed by the queens, followed by the jacks, followed by the numerical cards ten through two. The suit of the cards determines the hierarchy among similar cards in the deck. The suit hierarchy top begins with the spades as highest, then the hearts, then the diamonds, and then the clubs. Therefore, in terms of individual hierarchical value, the ace of spades is the highest card in the deck and the two of clubs is the lowest.

Each card in the deck also has a numerical value. FIG. 1 is a table showing numerical value. The numerical value for the aces is one, the numerical value for the face cards K, Q, J are ten, and the numerical value for the numerical cards ten through two are as shown respectively ranging from ten through two.

The strength of the hand is determined by taking two special hand classes that are the highest, then a standard hand class below the two special hand classes. The higher classes have higher value than the lower classes irrespective of other characteristics. The highest special hand is the three of a kind.

The second highest class is the three face card hand. The third highest class is the standard hand.

Adding the numerical value of all of the cards in the hand and taking the last digit as a point total gives the rank of the standard hand class. Therefore, a sum total of nine, 19 or 29 would yield a point total of nine. The sum of the three card hand is truncated to retain only the first digit, which is the units digit, and discarding the tens digit. Typically, a game would have a large number of standard hands and the point total would determine the winner.

Sometimes, players will have similar point total standard hands. In this case, a two step sub categorization is done. First if there are two face cards in a standard hand, this is higher than a single face card or a single ace. This is a special rank for standard hands, not to be confused with the two special classes. In the two face card standard hand, the player examines the rank of the highest face card to determine rank, rather than using the highest individual card.

Second, below the two face cards are standard rank hands. For standard rank hands the player examines the rank of the highest card as seen in FIG. 2. The rank is the calculated by taking the individual hierarchical value of the highest card in the hand to be the third criteria that is the rank of the hand. FIG. 2 is a table showing card rank. FIG. 2 shows the ranks from highest rank card to lowest as A, K, Q, J, 10, 9, 8, 7, 6, 5, 4, 3, 2. FIG. 2 shows a table of individual card ranks and also provides notation that the highest suit of each card is the spade noted by a lowercase s, then the hearts noted by a lowercase h, then the diamonds noted by a lowercase d, then the clubs noted by a lowercase c. The ellipses show that the series proceeds as above from Ks, Kh, Kd, Kc to 2s, 2h, 2d, 2c. It is simple to examine the rank of the hand that is the highest individual hierarchical value of the highest card. Thus, to tie break in the standard class, the point total criteria is used first followed by the highest rank criteria.

In actual play, the highest hand is often a standard hand of point total 8 or 9. Any given hand will likely be in the standard hand class. For example: a hand having a three of diamonds, a five of hearts and an eight of diamonds will have a standard class, then a point total of six because the numerical value is 16 and the last digit of 16 is 6. The hand would also have a rank eight of diamonds.

To tie break between the three of a kind and three face card special class hands, the point total criteria is skipped and the highest individual hierarchical value of the highest card is used.

FIG. 3 is a table showing hand strength in hierarchical order starting with the strongest hand.

The first hand is a three of a kind ace hand. This is the highest hand class being in the three of the kind class. If the hand also has the ace of spades, it would be the highest hand available in the three of the kind class, which would be a three of a kind ace of spades hand.

The second hand is a three face card king hand which would be lower than the first hand. The second hand has a King, Queen, Jack, which would be the second highest class. A king of spades in the hand would make it the highest hand among the three face card classes that would be a three face card king of spades hand.

The third hand is a two face card nine point king hand and would be lower than the second hand. It is in the standard class because it has a King, Queen, and Nine, but has special rank as a two face card. A King of spades in the hand would make it the strongest hand among the two face card standard class special rank making it a two face card nine point king of spades hand. Here, KQ9 beats QQ9.

The fourth hand is a standard nine point ace and would be lower than the third hand. The fourth hand is a standard hand because it does not have any criteria qualifying it for a special hand, yet it has the highest point total available which is nine. The Ace=1, therefore 1+8+10=19 which yields a total of nine points after truncation leaving the lowest single digit. A player receiving the fourth hand would likely not elect to change any cards, since it is a decently strong hand. The fourth hand has a rank of the highest card, which is an ace.

The fifth hand is a standard nine point king hand, and is lower than the fourth hand. The sixth hand is a standard nine point ten hand and slightly lower than the fifth hand. The seventh hand is a standard nine point nine hand and is slightly lower than the sixth hand. The eighth hand is a standard nine point eight hand, which is slightly lower than the seventh hand. The ninth hand is a standard nine point seven hand that is slightly lower than the eighth hand. The tenth hand is a standard nine point five hand slightly lower than the ninth hand. The eleventh hand is a standard nine point four hand.

The twelfth hand is the lowest hand available because it is a standard hand and has a 4, 4, 2 adding up to a total of 10 which would provide a point total of zero. If the two 4's were a four of diamonds and four of clubs, the hand would be a standard zero point four of diamonds hand. Typically though, this lowest hand is unlikely bad luck and it would be more likely that a slightly better hand would be received such as a 4 of spades, 4 of hearts, 2 of diamonds. There is no push because of the absolute hierarchy and use of a 52 card deck with no duplicates.

Final Processing

After each player looks at their hand strength, each player can have an option to change one of the cards to try to get a better hand. The option to change requires an estimation of percentages by the player.

The player puts the change card on the change box and the dealer deals the player a new card while putting the change card in the discard pile. A player purchasing multiple spots is not eligible for change of cards for any spot where the player has at least a standard hand class with a point total of eight or more.

After the players make election regarding the change card, the players reveal the cards simultaneously and the dealer tabulates the hand strengths. The strongest hand gets all of the first bets. The second bets are awarded to the strongest hand of the second bets, so that only a player wagering a second bet has the opportunity to win the second bets. Also, to be eligible to win the second bet, a player must have a better hand than a standard hand class with a point total of eight or more. If no player is eligible for the second bet, the second bet is refunded to the bettors. When no player wins the second bet, there is no service charge for the second bet.

The winner of the round receives winnings minus a contribution to the jackpot. The jackpot will have a predetermined winning pay out upon a payout event. The payout event can be common such as when a hand of three face cards beat another hand of three face cards. A second more difficult payout event could be when a hand of three ace cards beat a hand of three queens.

There is no jackpot when there are less than four spots played. The jackpot is shared equally among all of the players at the table who played the round. After the round is over, the button moves one spot clockwise. Because the game is played with a single deck of 52 cards, the deck must be shuffled at the end of each round.

As an alternate embodiment, a player may be given the option of additional change cards so that a player may change more than one change card. Thus, it is to be understood that the present invention is not limited to the sole embodiment describe above, but encompasses any and all embodiments within the scope of the following claims.

The invention claimed is:

1. A method of playing card game, comprising the steps of:

(a) dealing three cards in a round to form a three card hand;

(b) allowing a player to change a single card for said three card hand;

(c) comparing said three card hand for hand strength, which comprises the steps of:

(c.1) categorizing said three cards in said three card hand into one of a highest special hand class, a second highest special class and a standard hand class, wherein for said highest special hand class, a combination of said three card is three of a kind, wherein for said second highest special class, a combination of said three cards is three face cards, wherein for said standard hand class, wherein other combinations of said three cards are classified as said standard hand class, which has a lower standing than said highest special hand class and said second highest special class;

(c.2) when said three card hand forms said highest special hand class, tie-breaking said three of a kind of said highest special hand class by rank by an individual hierarchical value of a highest card among said three of a kind of said cards of said highest special hand class;

(c.3) when said three card hand forms said second highest special class, tie-breaking said three face cards by rank by an individual hierarchical value of a highest card among said three cards of said three face cards of said second highest special class;

(c.4) when said three card hand forms said standard hand class, tie-breaking said three cards of said standard hand class by the steps of:

(c.4.1) tie-breaking said three cards of said standard hand class by a point total criteria, wherein a point total of said three cards of said three cards of said three class hand equals a unit digit of a sum of a numerical value of said three cards, (c.4.2) tie breaking said three cards of said standard hand class by rank by assigning a special two face card rank higher than a standard rank, (c.4.3) tie-breaking said special two face card rank of said standard hand class by an individual hierarchical value of said cards having a highest face card; and (c.4.4) tie-breaking said individual hierarchical value of the highest card of said standard hand class by said individual hierarchical value of the highest card, wherein all cards are categorized into four suits when determining the individual hierarchical value of a card, said four suits being spades, hearts, diamonds and clubs; and (d) awarding a winner of said round, wherein a said winner of said round has a highest hand strength of said three card hand.

2. The method, as recited in claim 1, further comprising the steps of:

offering a first bet option among a plurality of players of said method;

awarding first bets to a highest hand and offering a second bet option to remaining players; and awarding second bets to a highest hand that places a second bet if said highest hand that places a second bet is at least a standard hand class with a point total of eight or more.

3. The method, as recited in claim 2, further comprising a step of providing a jackpot that accumulates from a set contribution from the winner of each round.

4. The method, as recited in claim 2, further comprising a step of assigning a button to a spot that rotates one spot clockwise each round.

5. The method, as recited in claim 2, further comprising a step of assigning a button to a spot, wherein a player holding said button has the first right of refusal to purchase empty spots, wherein when said player purchases an empty spot, said player waives the right to change a single card in any three card hand that is at least a standard hand class with a point total of eight or more.

6. The method, as recited in claim 1, wherein no player plays against and make a wager against a house, wherein a house does not place a bet, collect winnings or pay losses.

7. The method, as recited in claim 1, wherein said four suits that determine the individual hierarchical value of a card are spades, hearts, diamonds, and clubs, in which a standing of said suits are orderly ranked as spades, hearts, diamonds and clubs.

8. A method of playing a card game, comprising the steps of:

(a) dealing three cards in a round to form a three card hand;

(b) allowing a player to change one or more cards in said three card hand;

(c) comparing three card hands for hand strength, which comprises the steps of:

(c.1) categorizing said three cards in said three card hand into one of a highest special hand class, a second highest special class and a standard hand class, wherein for said highest special hand class, a combination of said three card is three of a kind, wherein for said second highest special class, a combination of said three cards is three face cards, wherein for said standard hand class, wherein other combinations of said three cards are classified as said standard hand class, which has a lower standing than said highest special hand class and said second highest special class;

(c.2) when said three card hand forms said highest special hand class, tie-breaking said three of a kind of said highest special hand class by rank by an individual hierarchical value of among said three of a kind of said cards of said highest special hand class;

(c.3) when said three card hand forms said second highest special class, tie-breaking said three face cards by rank by an individual hierarchical value of a highest card among said three cards of said three face cards of said second highest special class;

(c.4) when said three card hand forms said standard hand class, tie-breaking said three cards of said standard hand class by the steps of:

(c.4.1) tie-breaking said three cards of said standard hand class by a point total criteria, wherein a point total of said three cards of said three cards of said three class hand equals a unit digit of a sum of a numerical value of said three cards;

(c.4.2) tie breaking said three cards of said standard hand class by rank by assigning a special two face card rank higher than a standard rank, (c.4.3) tie-breaking said special two face card rank of said standard hand class by an individual hierarchical value of said cards having a highest face card; and (c.4.4) tie-breaking said individual hierarchical value of the highest card of said standard hand class by said individual hierarchical value of the highest card, wherein all cards are categorized into four suits when determining the individual hierarchical value of a card, said four suits being spades, hearts, diamonds and clubs; and (d) awarding a winner of said round, wherein a said winner of said round has a highest hand strength of said three card hand.

9. The method, as recited in claim 8, further comprising the steps of:

offering a first bet option among a plurality of players of said method;

awarding first bets to a highest hand and offering a second bet option to remaining players; and awarding second bets to a highest hand that places a second bet if said highest hand that places a second bet is at least a standard hand class with a point total of eight or more.

10. The method, as recited in claim 9, further comprising a step of providing a jackpot that accumulates from a set contribution from the winner of each round.

11. The method, as recited in claim 9, further comprising a step of assigning a button to a spot that rotates one spot clockwise each round.

12. The method, as recited in claim 9, further comprising a step of assigning a button to a spot, wherein a player holding said button has a right of refusal to purchase empty spots, wherein when said player purchases an empty spot, said player waives a right to change a single card in any three card hand that is at least a standard hand class with a point total of eight or more.

13. The method, as recited in claim 8, wherein no player plays against and make a wager against a house, wherein a house does not place a bet, collect winnings or pay losses.

14. The method, as recited in claim 8, wherein said four suits that determine the individual hierarchical value of a card are spades, hearts, diamonds, and clubs, in which a standing of said suits are orderly ranked as spades, hearts, diamonds and clubs.

* * * * *